US006499441B2

(12) United States Patent
Suzuki

(10) Patent No.: US 6,499,441 B2
(45) Date of Patent: Dec. 31, 2002

(54) ENGINE GENERATOR

(75) Inventor: Misao Suzuki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,999

(22) Filed: Apr. 16, 2001

(65) Prior Publication Data

US 2001/0029908 A1 Oct. 18, 2001

(30) Foreign Application Priority Data

Apr. 14, 2000 (JP) ..... 2000-113401
Apr. 14, 2000 (JP) ..... 2000-113698

(51) Int. Cl.[7] ..... F02B 63/00
(52) U.S. Cl. ..... 123/2
(58) Field of Search ..... 123/2

(56) References Cited

U.S. PATENT DOCUMENTS 6,095,099 A * 8/2000 Morohoshi et al. ..... 123/2

FOREIGN PATENT DOCUMENTS

JP 1136880 2/1999 ..... F02B/63/04

* cited by examiner

*Primary Examiner*—Paul J. Hirsch
(74) *Attorney, Agent, or Firm*—Martin A. Farber

(57) ABSTRACT

It is an object of the invention to improve a cooling efficiency for cooling an engine generator by dividing a cooling air passage into two routes. The engine generator includes an engine, a generator, a muffler and a cooling fan, which are all enclosed in a housing. A first cooling air passage is formed adjacent to a cylinder of the engine. A second cooling air passage is formed beneath the engine, extending from the lower side of the cooling fan, passing through an area below the engine and arriving at the muffler. The second cooling air passage is formed between an oil pan and a vibration isolation support base plate, with the oil pan facing the second cooling air passage. In this way, an air supplied from the cooling fan is divided into two routes, with one cooling the cylinder head of the engine and the other the lower portion of the engine and the muffler. When the second cooling passage is partially formed by the vibration isolation support base plate, a longer span can be obtained by the vibration isolation support base plate. Therefore, a vibration isolation member is provided on each end of the vibration isolation support base plate for effectively reducing the engine vibration.

6 Claims, 2 Drawing Sheets

ENGINE GENERATOR

BACKGROUND OF THE INVENTION

The present invention relates to an engine generator comprising an engine and a generator driven by the engine. In particular, this invention relates to an engine generator capable of cooling the engine by means of a cooling fan driven by the engine.

Conventionally, as an electric power source for use in an outdoor condition as a road construction, a road repairing operation, or an out-door shop and leisure service, there has been in use an engine generator comprising an engine and a generator driven by the engine, both of which are enclosed in a housing so as to form an arrangement capable of producing an electric power. In fact, such an engine generator is so constructed that a rotor equipped with several pieces of magnet is fixed on a crank shaft, in a manner such that the rotor can rotate in the vicinity of a stator equipped with a plurality of coils, thereby generating an electric power. In order to cool the engine and the generator as well as a muffler, a cooling fan driven by the engine is provided within the housing. In this manner, with the rotation of the crank shaft, the cooling fan can also be rotated, thus forming an arrangement capable of introducing an outside cool air into the housing so as to cool the engine and the generator as well as the muffler.

Japanese Unexamined Patent Laid-open Application Publication No. 11-36880 has disclosed an improved cooling structure suitable for use in an air-cooling type engine generator equipped with a cooling fan. This patent publication teaches that an outer rotor type generator may be used, and a housing encloses the generator, an engine and a muffler, which are arranged successively and covered by a duct and a fan cover. Further, the prior art publication discloses that a cooling fan is attached to the outside of the outer rotor of the generator, in a manner such that the cooling fan can rotate together with the crank shaft of the rotor, thereby introducing an external cooling air into the housing. In fact, the cooling air is rendered to at first cool the generator having a relatively low temperature, then the engine and the muffler (both of which have a relatively high temperature). Finally, the used cooling air is discharged to the outside of the housing.

However, with the above described engine generator disclosed in the above mentioned patent publication, the muffler is cooled only after the engine has been cooled, the cooling air for cooling the muffler is air already used in cooling the engine and thus is a warm air. As a result, the efficiency of cooling the muffler is lower than a condition in which the muffler is directly cooled by an outside cold air.

SUMMARY OF THE INVENTION

It is an object of the present invention to obtain an improved cooling efficiency for an engine generator by dividing a cooling air passage into two routes, with one cooling the cylinder head of the engine, while the other the oil pan and the muffler, so as to solve the above-mentioned problem peculiar to the above-discussed prior art.

An engine generator of the present invention comprises a base, an engine disposed on the base; a generator driven by the engine; a muffler positioned on the exhaust side of the engine; a cooling fan driven by the engine; a housing enclosing the engine, the generator, the muffler and the cooling fan; a first cooling air passage formed on the cylinder head side of the engine for cooling the upper portion of the engine by a cooling air supplied from the cooling fan; and a second cooling air passage extending from the lower side of the cooling fan and passing under the lower side of the engine and arriving at the muffler for cooling the lower portion of the engine and the muffler by said cooling air supplied from the cooling fan.

According to the present invention, the cooling air has been divided into two routes, with one being used only for cooling the cylinder head and the other for cooling the lower portion of the engine and the muffler. In this way, it is possible to cool both the upper and lower portions of the engine, while at the same time ensuring that a cooling air for cooling the muffler has a lower temperature than that of an air which has just been used for cooling the cylinder head of the engine.

Further, since an oil pan of the engine is disposed to face the second cooling air passage, it is possible to use a cooling air flowing through the second cooling air passage to effectively cool the oil pan located on the underside of the engine.

In addition, it is possible that the second cooling air passage may be interposed between the oil pan of the engine and a vibration isolation support base plate attached under the lower side of the engine and extending in the extending direction of the crank shaft of the engine, thereby rendering it possible to form the second cooling air passage by effectively making use of the engine support structure. On the other hand, it is also possible to inhibit the propagation of an engine vibration, based on that vibration isolation members interposed at the end portions of the vibration isolation support base plate.

The above objects and features of the present invention will become better understood from the following description with reference to the accompanying drawings.

DETAILED DESCRIPTION OF THE PREFERRED EMBODIMENTS

Figure 1:
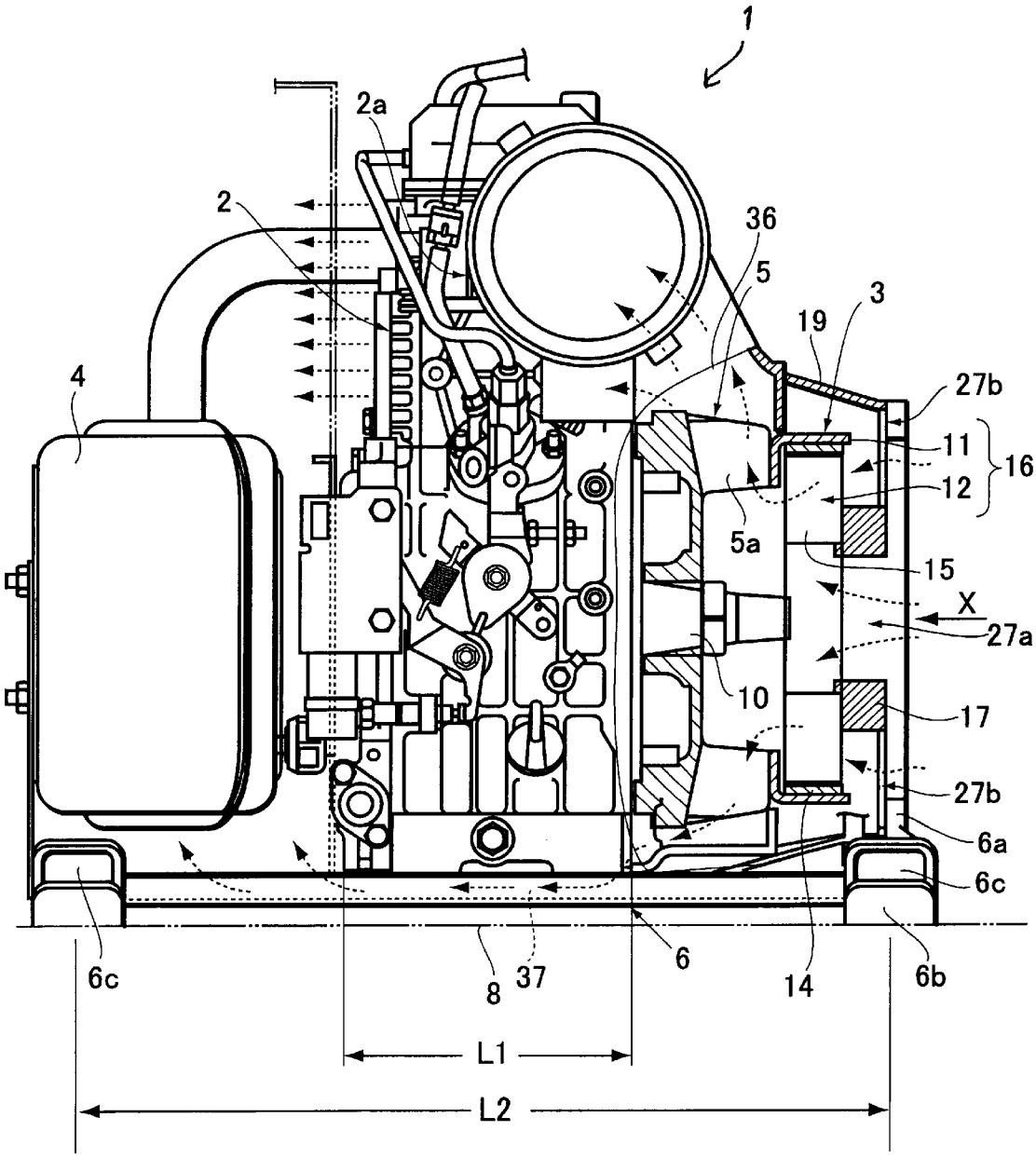
FIG. 1 is an explanatory side elevation showing the internal structure of an engine generator formed according to an embodiment of the present invention.
Figure 2:
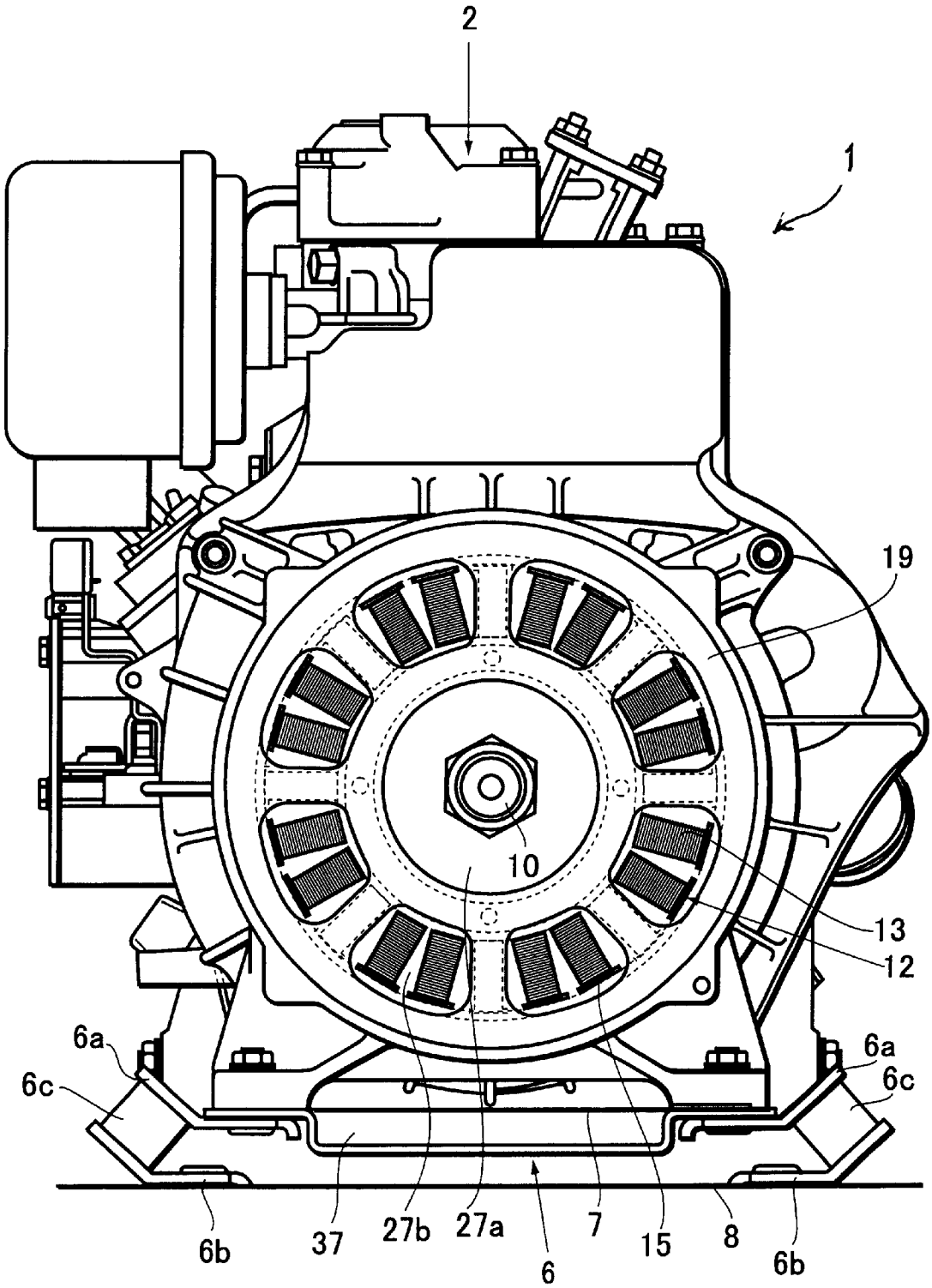
FIG. 2 is an explanatory elevation showing the internal structure of the same engine generator, when viewed along the X direction in FIG. 1.

One embodiment of the present invention will be described in detail below with reference to the accompanying drawings. FIG. 1 is an explanatory side elevation view showing the internal structure of an engine generator formed according to an embodiment of the present invention. FIG. 2 is an explanatory elevation showing the internal structure of the same engine generator, when viewed along the X direction in FIG. 1.

As shown in the drawings, the engine generator 1 of the present embodiment is an electricity generating equipment of a type so formed that its generator is driven by an engine. In detail, the engine generator 1 comprises an engine 2, a generator 3, a muffler 4 and a cooling fan 5, which are all mounted on a base 8 and enclosed within a housing. Further provided within the housing is a first cooling air passage 36 for cooling the upper portion of the engine 2, a second cooling air passage 37 for cooling the lower portion of the engine 2 and the muffler 4, thereby forming an arrangement capable of obtaining an improved cooling efficiency for cooling the engine 2 and the muffler 4.

Here, the engine 2 is a general Diesel engine having a crank shaft 10. The generator 3 is an outer rotor type multipolar generator, which is located on the right side (in FIG. 1) of the engine 2. With the rotation of the crank shaft 10, the generator 3 is driven to generate an electricity. On the other hand, an exhaust gas discharged from the engine 2 is at first sent to the muffler 4 located on the left side (in FIG. 1) of the engine 2, then subjected to an exhaust gas noise decrement (reduction) treatment, and finally discharged to the outside through an exhaust gas outlet (not shown).

Further, a cooling fan 5, acting as a fly wheel, is fixed on the crank shaft 10 of the engine 2. A plurality of wings 5*a* are formed on the outer periphery of the cooling fan 5, facing away from the engine 2. An outer rotor 11 having a cylindrical shape is fixed on the front end of each wing 5*a*. In this manner, with the starting of the engine 2, the cooling fan 5 is rotated, so that an outside air can be introduced inwardly into the engine generator 1 from the right side (in FIG. 1), through cooling air inlets 27*a* and 27*b* formed on a fan cover 19, along the routes indicated by broken lines in FIG. 1, thereby supplying a cooling air to the engine 2.

Furthermore, in the engine generator 1, the engine 2 is mounted on the base 8 through a vibration isolation support base plate 6. In detail, the vibration isolation support base plate 6 is provided on each end thereof with a vibration isolation support plate 6*a* and a bracket 6*b*, as well as a vibration isolation member 6*c* interposed between the support plate 6*a* and the bracket 6*b*.

The vibration isolation support plates 6*a*, as shown in FIG. 2, are attached to the underside of the oil pan 7 of the engine 2, with the oil pan 7 being interposed between the vibration isolation support plates 6*a*. The brackets 6*b* are attached on the base 8, with each facing a corresponding vibration isolation support plate 6*a*. As related in the above, each vibration isolation member 6*c* is interposed between a corresponding vibration isolation support plate 6*a* and a corresponding bracket 6*b*.

Here, the vibration isolation support base plate 6 is so formed that it has a length L2 longer than a length L1 (see FIG. 1) in the extending direction of the crank shaft of the engine 2. Namely, the length of the vibration isolation support base plate 6 is longer than the total length of the engine 2 in its axial direction, extending from the inner side of the fan cover 19 to the muffler 4.

Specifically, each vibration isolation member 6*c* is made of a resilient material such as a rubber or a synthetic resin, and is interposed between a corresponding vibration isolation support plate 6*a* and a corresponding bracket 6*b*, located at each end of the vibration isolation support base plate 6. Namely, the engine 2 is mounted on the vibration isolation support base plate 6 having a length longer than that of the engine 2, and is supported through each end thereof by a vibration isolation member 6*c*. This means that the support span for the engine 2, has a length L2 extending from the fan cover 19 to the muffler 4, in a manner as shown in FIG. 1.

In this way, the engine generator 1 of the present embodiment has a larger support span than that of a conventional engine generator (in which an engine is supported on a vibration isolation support section positioned right under the engine). Therefore, in the present embodiment it is possible for the engine 2 to be mounted on a support structure having an increased span, thereby making it possible to more effectively inhibit an undesired propagation of the vibration from the engine 2 to the base 8.

Further, in the engine generator 1 of the present embodiment, the second cooling air passage 37 is partially formed by the vibration isolation support base plate 6. As shown in FIGS. 1 and 2, the vibration isolation support base plate 6 presents a cross section indicating that an elongated internal space has been formed under the oil pan 7 of the engine 2. Thus, the elongated internal space can be used as the cooling air passage 37 for cooling the engine 2 and the muffler 4, thereby obtaining an improved cooling efficiency.

In particular, as shown in FIG. 1, the cooling air passage 37 is so formed that it extends from the lower outside of the cooling fan 5, passing under the lower side of the engine 2 and arriving at the lower side of the muffler 4. Thus, the cooling air passage 37, as shown in FIG. 2, involves the bottom surface of the oil pan 7 of the engine 2. Therefore, an outside cooling air introduced by the cooling fan 5 and then moved in the centrifugal direction, can partially flow to the lower side of the engine 2, then into the cooling air passage 37, in a manner as shown in FIG. 1. Thus, the cooling air introduced into the cooling air passage 37 is rendered to at first cool the oil pan 7, and then flow towards the muffler 4. Subsequently, the cooling air is caused to flow upwardly from the lower side of the muffler 4 so as to cool the upper portion of the muffler 4. After being used in cooling the muffler 4, the cooling air is discharged outwardly from the engine generator 1.

In addition, the second cooling air passage 36 is formed in the vicinity of the cylinder head 2*a* of the cylinder 2. Namely, in the engine generator 1 of the present invention, the cooling air has been divided into two routes, with one passing through the cooling air passage 36 to cool the upper portion of the engine 2, and the other passing through the cooling air passage 37 to cool the lower portion of the engine 2 and the muffler 4.

In fact, the cooling air passage 36 is formed within the fan cover 19 and an engine cover (not shown), extending from the outside of the cooling fan 5, passing through the upper side of the engine 2, finally arriving at the upper side of the muffler 4. Here, the cooling air introduced inwardly by the cooling fan 5 in the centrifugal direction will partially flow to the upper side of the engine 2, and then enter the cooling air passage 36. In this way, the cooling air introduced into the cooling air passage 36 is rendered to at first cool the cylinder head 2*a* of the engine 2 and then flow towards the muffler 4. After flowing over the upper side of the muffler 4, the cooling air is discharged to the outside of the engine generator 1. However, when the cooling air flows over the upper side of the muffler 4, it is also possible to use the same flow of the cooling air to cool the main body portion of the muffler 4.

Here, since the oil pan 7 has a lower temperature than the cylinder head 2*a*, the cooling air flowing through the cooling air passage 37 and arriving at the muffler 4 has a lower temperature than the air used in cooling the cylinder head. In other words, when compared with the above described prior art in which an air used in cooling the cylinder head is supplied to the muffler 4, the engine generator 1 of the present embodiment can ensure that a cooling air having a lower temperature is supplied to the muffler 4, thereby obtaining an improved cooling efficiency for cooling the muffler 4 which has the highest temperature in the engine generator 1.

Furthermore, since the engine generator 1 of the present embodiment is so formed that the structure of its vibration isolation support base plate 6 can be used to form the cooling air passage 37, it has become possible not only to improve a cooling efficiency for cooling both the engine 2 and the muffler 4, but also to prevent the propagation of the vibration from the engine 2, thereby obtaining an effect of killing two birds with one stone, without increasing the number of the parts forming the engine generator.

On the other hand, the outer rotor 11 is attached to the cooling fan 5, in a manner such that its one side facing away from the engine 2 is in an opened condition. A plurality of magnets 14 are provided on the inner circumferential surface of the outer rotor 11. Further, a stator 12 is provided on the inner side of the outer rotor 11, thereby forming an power generating body 16 consisting of the outer rotor 11 and the stator 12.

As shown in FIG. 2, the stator 12 has a stator core section 15 including a plurality of coils 13 wound around a plurality of radially protruding yokes. In this way, on starting the engine 2, the outer rotor 11 will be rotated, thus causing the magnets 14 to revolve around the coils 13. In this way, an electromotive force is generated in the coils 13, thereby effecting a desired electricity generation.

In this way, since the stator 12 is fixed on the inner side of the fan cover 19, if necessary, the stator 12 can be replaced by a new one only by removing the fan cover 19. Namely, as shown in FIG. 1, on the right end of the fan cover 19 there is provided an annular attachment member 17, so that the stator 12 can be fixed within the fan cover 19 by virtue of the annular attachment member 17. When the fan cover 19 is attached to the engine 2, the stator 12 will be inserted to the inner side of the outer rotor 11, thereby forming the generator 3.

In maintenance of the engine generator 1, at first, the fan cover 19 is removed, so that the stator 12 can be separated from the engine generator 1. In this manner, it becomes possible to replace an old stator 12 with a new one, without having to remove other parts such as the outer rotor 11, thereby ensuring an easy operation for the maintenance of the engine generator 1.

Further, when the fan cover 19 is attached to the engine 2, an electricity generating arrangement 16 (including the outer rotor 11 and the stator 12) can be completely accomodated into the fan cover 19. Therefore, it is allowed to keep the generator 3 in only one housing, making it possible to reduce the number of parts forming the engine generator and at the same time to improve its water tightness.

The electric power generated in the coils 13 is sent to an inverter unit (not shown) and is converted into an alternating current having a predetermined frequency, so that an electric power can be output by operating a control panel provided on the housing of the engine generator. Here, since the inverter unit is used to effect a frequency conversion to supply an electric power having a predetermined frequency, and since the frequency of an output power can be maintained at a constant value, it is allowed not to keep the engine speed at a certain constant value, irrespective of the magnitude of a load. In this way, the engine 2 is allowed to operate under an optimum condition in accordance with an actual load. For this reason, with the exception of an extremely large load, it becomes possible to control the engine at a lower speed than a conventional engine generator, thereby making it possible to reduce the engine noise and improve the fuel consumption.

In addition, on the outside of the fan cover 19 there is provided a coil starter (not shown), so that once a human operator pulls a rope connected with the starter, the crank shaft 10 is rotated so as to start the engine.

Although the present invention has been described in the above in accordance with the above-discussed embodiment, it should be understood that this invention should not be limited to such a specific embodiment. In fact, it is possible to make various modifications to the present invention without departing from its inventive spirit.

For example, although it has been described in the above embodiment that the vibration isolation member **6*c* is made from a rubber material or a synthetic resin, it is also possible that the vibration isolation member 6*c* may be a plate spring or a coil spring. Further, although the above embodiment shows that the engine 2** is a general Diesel engine, it is also possible to substitute a gasoline engine for the general Diesel engine.

The advantages of the present invention may be concluded as follows.

Namely, in the engine generator of the present invention, there is formed a first cooling air passage for cooling the upper portion of the engine and a second cooling air passage for cooling the lower portion of the engine and the muffler. In this way, it is possible to cool both the upper and the lower portions of the engine, while at the same time supplying an air having a relatively low temperature to the muffler. Therefore, it becomes possible to obtain an improved efficiency for cooling both the engine and muffler, thus rendering it possible for the engine to have an increased output and for the muffler to have an extended life time.

Further, since the oil pan of the engine is disposed to face the second cooling air passage, the oil pan may be effectively cooled by the cooling air flowing through the second cooling air passage, thereby improving an efficiency in cooling the engine.

Moreover, since the second cooling air passage is formed between the oil pan and the vibration isolation support base plate, it becomes possible to make full use of the engine support structure to form cooling structure. Accordingly, two cooling routes are formed without increasing the total number of the parts forming the engine generator, thereby ensuring an improved space efficiency and thus making it possible to produce an improved engine generator having a compact size.

In addition, as described in the above, when the second cooling air passage is partially formed by the vibration isolation support base plate, the following constitution can thus be formed which includes a plurality of vibration isolation support plates each provided on an end portion of the vibration isolation support base plate; a plurality of brackets each facing one of the vibration isolation support plates; a plurality of vibration isolation members, each interposed between one vibration isolation support plate and one bracket. Accordingly, it is allowed to have a large span between support points on the engine, thereby forming a long span support structure for the engine. In this way, interposing the vibration isolation members between the vibration isolation. support plates and the brackets is proved to be useful for effectively attenuating the engine vibration.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. An engine generator comprising:

a base;

an engine disposed on the base;

a generator driven by the engine;

a muffler positioned on the exhaust side of the engine;

a cooling fan driven by the engine;

a housing enclosing the engine, the generator, the muffler and the cooling fan;

a first cooling air passage formed on the cylinder head side of the engine for cooling the upper portion of the engine by a cooling air supplied from the cooling fan; and a second cooling air passage extending from the lower side of the cooling fan and passing under the lower side of the engine and arriving at the muffler for cooling the lower portion of the engine and the muffler by said cooling air supplied from the cooling fan.

2. An engine generator according to claim 1, wherein:

the engine has an oil pan disposed to face the second cooling air passage.

3. An engine generator according to claim 1, wherein:

the second cooling air passage is formed between the oil pan of the engine and a vibration isolation support base plate attached under the engine and extending parallel to a crank shaft of the engine.

4. An engine generator according to claim 3, further comprising:

a plurality of vibration isolation support plates provided on end portions of the vibration isolation support base plate for supporting the vibration isolation support base plate;

a plurality of brackets provided on the base of the engine generator wherein each bracket faces a corresponding vibration isolation support plate; and a plurality of vibration isolation members interposed between vibration isolation support plates and brackets, for inhibiting a transmission of an engine vibration through the vibration isolation support plates towards the brackets.

5. An engine generator according to claim 4, wherein:

the vibration isolation support base plate is formed in a size being longer than a length of the engine in a crank shaft extending direction.

6. An engine generator according to claim 1, wherein:

the first cooling air passage is formed within a cover of the fan, extending from outside of the cooling fan through an upper side of the engine and to an upper side of the muffler.

* * * * *